US006217641B1

(12) United States Patent
Gunnarsson

(10) Patent No.: US 6,217,641 B1
(45) Date of Patent: Apr. 17, 2001

(54) DUST CONTAINER FOR A VACUUM CLEANER

(75) Inventor: Kent Gunnarsson, Vänersborg (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/244,227

(22) Filed: Feb. 2, 1999

(30) Foreign Application Priority Data

Feb. 6, 1998 (SE) ..... 9800348

(51) Int. Cl.[7] ..... B01D 29/13; B01D 35/14

(52) U.S. Cl. ..... 96/404; 55/DIG. 2; 55/DIG. 3; 15/339

(58) Field of Search ..... 55/367, 369, DIG. 3, 55/DIG. 2, DIG. 34; 15/339, 412; 96/404, 423

(56) References Cited

U.S. PATENT DOCUMENTS 3,328,942 * 7/1967 Waters ..... 55/DIG. 3
4,001,912 * 1/1977 Eriksson ..... 55/DIG. 3
4,452,618 * 6/1984 Kuplas ..... 55/DIG. 3
4,545,794 * 10/1985 Himukai ..... 55/DIG. 3
5,701,631 * 12/1997 Linquist ..... 15/327.1
5,907,886 * 6/1999 Buschler ..... 15/319

FOREIGN PATENT DOCUMENTS

3434209 * 3/1986 (DE) .
0026469 * 3/1978 (JP) ..... 55/DIG. 3
0026470 * 3/1978 (JP) .
11-155783 * 6/1999 (JP) .

* cited by examiner

*Primary Examiner*—David A. Simmons
*Assistant Examiner*—Robert A. Hopkins
(74) *Attorney, Agent, or Firm*—Pearne & Gordon LLP

(57) ABSTRACT

A dust container for a vacuum cleaner having contacts electrically connected to an electric circuit that permits the vacuum cleaner to be activated only when an electrical connection is established between the contacts. The dust container includes a bag of air pervious material having an opening formed therein. A plate covers the opening in the bag. The plate is formed from at least two layers of cardboard and has an opening extending therethrough. An electrical conductor is disposed between the layers of cardboard. When the dust container is properly mounted in the vacuum cleaner, the electrical conductor establishes and electrical connection between the contacts, thereby permitting the vacuum cleaner to be activated.

4 Claims, 1 Drawing Sheet

DUST CONTAINER FOR A VACUUM CLEANER

BACKGROUND OF THE INVENTION

This invention relates to a dust container having a bag of air pervious material with an opening covered by a plate, the plate being provided with an opening through which dust laden air flows into the bag.

Dust containers of the type mentioned above are known and are currently used in vacuum cleaners to achieve a hygienic handling of the dust being collected. There are, however, a large number of different types of dust containers on the market. Each type of dust container suits one or several models of vacuum cleaners, the plate of each dust container being shaped such that it should solely suit the particular model or models that the dust container is intended for. In order to prevent the wrong dust container from being inserted into the vacuum cleaner or to prevent the vacuum cleaner from being started without a dust container, the vacuum cleaner is usually provided with sensing means connected to the electric circuit of the vacuum cleaner. The sensing means prevents dust from flowing into the fan unit and to the outlet filter, which is normally placed after the fan unit, if a dust container is not inserted. Such sensing means could be a micro switch sensing the presence of the plate or the dust container, pneumatic sensors, see GB 1494310, which are blocked by the plate when the wrong dust container is inserted or electromagnetic sensors (including optical methods) for sensing identification means on or within the dust container, see EP-A-790030.

However, all these methods have certain deficiencies. Micro switches indicate the presence of the dust container, but do not indicate whether the correct dust container is used. Pneumatic sensors and, in particular, the flow paths within the plate of the dust container, are sensitive to disturbances because of their small dimensions. Electromagnetic sensors are comparatively complicated and, thus, rather expensive.

Accordingly, there is a need in the art for a dust container that is simple to manufacture and enables the vacuum cleaner to identify the dust container so as to permit the vacuum cleaner to be started only when the correct dust container has been placed in the correct position in the vacuum cleaner. The present invention is directed to such a dust container.

SUMMARY OF THE INVENTION

It therefore would be desirable, and is an advantage of the present invention, to provide a dust container for a vacuum cleaner having contacts electrically connected to an electric circuit that permits the vacuum cleaner to be activated only when an electrical connection is established between the contacts. The dust container includes a bag of air pervious material having an opening formed therein. A plate covers the opening in the bag. The plate has an opening formed therein and includes an electrical conductor for establishing an electrical connection between the contacts of the vacuum cleaner.

BRIEF DESCRIPTION OF THE DRAWINGS

The features, aspects, and advantages of the present invention will become better understood with regard to the following description, appended claims, and accompanying drawings where:

DETAILED DESCRIPTION OF THE PREFERRED EMBODIMENTS

Figure 1:
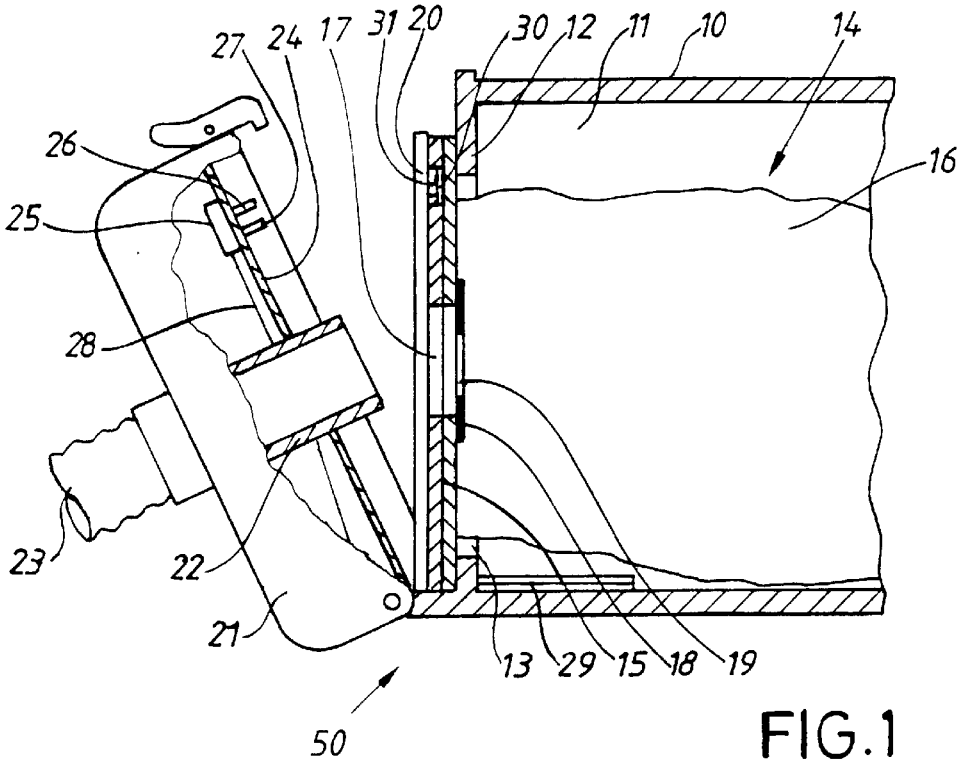
FIG. 1 shows a broken-away view of a vacuum cleaner having a dust container disposed therein.
Figure 2:
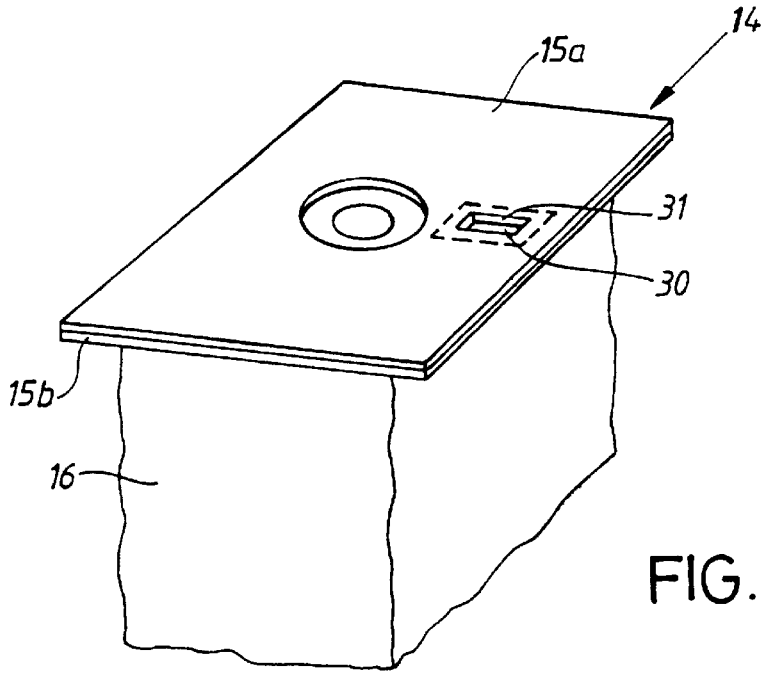
FIG. 2 is a perspective view of the dust container.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

FIG. 1 shows a shell 10 of a vacuum cleaner 50 having a chamber 11 that in a traditional manner communicates with a fan unit, not shown. The chamber 11 has a front wall 12 with an opening 13 through which a dust container 14 can be partly inserted. The dust container 14 comprises a plate 15, preferably a multilayered cardboard plate, that is connected to a filter bag 16 of air pervious material. The plate 15 has an inlet opening 17, which is partly covered by a flexible sealing membrane 18 having a central opening 19. When inserted into the vacuum cleaner 50, the plate 15 of the dust container frictionally engages a shoulder 20 partly surrounding the plate 15.

A cover 21 is pivotably connected to the shell 10. The cover 21 is provided with an inlet sleeve 22, which is connected to a hose 23 of the vacuum cleaner 50. The sleeve 22 extends toward the chamber 111 in such a manner that when the cover 21 is closed, a free end of the sleeve 22 extends through the opening 19 in the flexible membrane 18, and the membrane 18 seals against the sleeve 22. The cover 21 is also provided with a wall 24 that supports contact means 25 comprising two pins 26, 27 extending in the same direction as the sleeve 22. The pins 26, 27 are connected to electric conductors of a cable 28, which is connected to an electric circuit 29 of the vacuum cleaner 50. The cable 28 directs a small electric control current from the electric circuit 29 to the pins 26, 27. The circuit 29 is arranged such that a fan unit (not shown) will start only if there is an electrical connection between the two pins 26, 27, i.e., only if the control current flows between the pins 26, 27.

In order to achieve said electrical connection between the pins 26, 27, an electrical conductor 30, such as aluminum foil, or a thread, strip or layer of another electrically conductive material is arranged between upper and lower layers 15*a*, 15*b* of the plate 15, and the upper layer 15*a* is provided with an opening 31. When the cover 21 is closed and the dust container 14 is inserted in the vacuum cleaner 50, the two pins 26, 27 will abut the conductor 30, thereby establishing an electrical connection between the two pins 26, 27, and permitting the fan unit to be started. The small control current directed to the two pins 26, 27 should be of such character that there is no danger to the operator.

The conductor 30 is sized to cover the area of the plate 15 delimited by the pins 26, 27 when the cover 21 is closed and the pins 26, 27 contact the plate 15. The conductor 30 can be made larger than is shown, which would permit the two pins 26, 27 to be separated from each other and to extend through separate openings in the upper layer 15*a*. By positioning the two pins 26, 27 (and the corresponding openings in the container layer 15*a*) at different positions on the plate 15 it is thus possible to create several different contact patterns for different types of vacuum cleaners with associated dust containers.

It should be appreciated that in another embodiment of the present invention, the conductor 30 is disposed between the lower layer 15*b* and the shell 10 of the vacuum cleaner 50. In this embodiment, aligned openings are formed in the upper and lower layers 15*a,* 15*b* to permit the contact pins 26, 27 to extend through the plate 15 and contact the conductor 30.

Although the preferred embodiments of this invention have been shown and/or described, it should be understood that various modifications and rearrangements of the parts may be resorted to without departing from the scope of the invention as disclosed and claimed herein.

What is claimed is:

1. A dust container for a vacuum cleaner having contacts electrically connected to an electric circuit that permits the vacuum cleaner to be activated only when an electrical connection is established between the contacts, said dust container comprising:

a bag of air pervious material having an opening formed therein; and a plate covering the opening in the bag, said plate having an opening formed therein and including an electrical conductor for establishing an electrical connection between the contacts of the vacuum cleaner.

2. The dust container of claim 1, wherein the electrical conductor is aluminum foil.

3. The dust container of claim 1, wherein the plate further comprises a pair of cardboard layers; and wherein the electrical conductor is disposed between the cardboard layers.

4. The dust container of claim 3, wherein one of the cardboard layers has at least one opening through which the contacts of the vacuum cleaner may extend so as to contact the electrical conductor.

* * * * *